US005509169A

United States Patent [19]

Drucker

[11] Patent Number: 5,509,169

[45] Date of Patent: Apr. 23, 1996

[54] PAINT TRAY WITH PAINT BRUSH HOLDER

[76] Inventor: Mel Drucker, 64-34 99th St., Rego Park, N.Y. 11374

[21] Appl. No.: 448,677

[22] Filed: May 24, 1995

[51] Int. Cl.[6] ..... B44D 3/12

[52] U.S. Cl. ..... 15/257.06; 15/257.05; 206/509; 220/697; D32/53.1

[58] Field of Search ..... 15/257.05, 257.06; 206/229, 361, 509; 220/697, 700; D32/53.1

[56] References Cited

U.S. PATENT DOCUMENTS

| | | | |
|---|---|---|---|
| 540,129 | 5/1895 | Wohltman | 15/257.05 |
| 2,487,990 | 11/1949 | Soens | 220/697 |
| 2,661,858 | 12/1953 | Howell | 15/257.06 |
| 3,087,190 | 4/1963 | Werner | 15/257.06 |
| 3,595,431 | 7/1971 | Bird | 220/697 |
| 3,837,034 | 9/1974 | Leffert et al. | 15/257.06 |
| 4,094,431 | 6/1978 | Wheeler | 15/257.06 |
| 4,854,470 | 8/1989 | Ireland | 220/697 |
| 4,890,353 | 1/1990 | Shannon et al. | 15/257.06 |
| 5,038,955 | 8/1991 | Studer et al. | 15/257.06 |
| 5,123,576 | 6/1992 | Lawrence | 220/697 |

FOREIGN PATENT DOCUMENTS

| | | | |
|---|---|---|---|
| 234635 | 7/1961 | Australia | 15/257.06 |

*Primary Examiner*—Mark Spisich
*Attorney, Agent, or Firm*—Galgano & Burke

[57] ABSTRACT

A paint tray, for use in painting with a paint roller and paint brush includes a rectangularly shaped bottom with a surrounding vertically extending raised wall which has at the upper edge of the wall vertically extending tabs for easily and quickly retaining a paint brush in a generally horizontally disposed orientation across upper edges of adjacent raised side walls, i.e., one corner of the tray, adjacent the paint well or reservoir. The paint tray allows a painter to quickly alternate between use of a paint roller and a paint brush in that the paint tray provides a non-interfering place for securely placing the paint brush when using the paint roller. A preferred embodiment of the paint tray includes a surrounding vertically extending raised wall which has at the upper edge of the wall cutouts for retaining a paint brush in a generally horizontally disposed orientation across upper edges of adjacent raised side walls, i.e., a corner, adjacent the paint well or reservoir.

16 Claims, 2 Drawing Sheets

PAINT TRAY WITH PAINT BRUSH HOLDER

BACKGROUND OF THE INVENTION

The present invention relates generally to a paint tray. More particularly, the present invention relates to an improved paint tray with paint brush holder for use with a paint roller and paint brush.

A painter, either a homeowner or a professional, will typically use both a paint roller and paint brush, along with a paint tray, to paint the interior of a room. Specifically, a painter will use a paint roller to quickly paint the large easily accessible surface areas of the walls and ceiling, and use a paint brush to paint those surface areas inaccessible with the paint roller such as the corners between adjacent walls, the corners between the walls and the ceiling, and areas around doors, windows and the floor.

A conventional paint tray is typically made out of metal or preferably plastic, and is generally rectangularly shaped having a bottom with raised sides. The bottom of the paint tray includes a well or reservoir at one end for receiving a supply of paint and an inclined surface tapering upwardly from the paint well to the opposite end of the paint tray. The inclined surface provides a surface upon which a painter may roll a paint roller or brush a paint brush to remove excess paint therefrom.

Often a painter will alternate between use of a paint roller and a paint brush while painting a room necessarily requiring finding a location to place or rest the paint roller or paint brush when using the other. A painter, when not using the paint roller, can easily place the paint roller on the inclined surface of a paint tray. However, a painter, when not using the paint brush, must find a convenient location to place the paint brush. Leaning the paint brush against a raised side of the paint tray on the inclined surface of the paint tray interferes with applying paint to the paint roller. Laying the paint brush on top of adjacent raised sides, i.e., corner, of the paint tray adjacent the inclined surface also interferes with the use of the paint roller and can be easily dislodged. Laying the paint brush on top of adjacent raised sides, i.e., corner, of the paint tray adjacent the paint well is risky in that if the paint brush is dislodged may fall, partially or completely, into the paint well.

An example of a paint can accessory which includes a paint tray for supporting or holding a paint roller and a paint brush is disclosed in U.S. Pat. No. 5,123,576 granted to Lawrence. Lawrence, discloses a paint tray having a cylindrical base portion that engages and secures to the top edge of a paint can. Attached to the cylindrical base portion is a horizontal plate which forms a tray for distributing paint to a paint roller. The horizontal plate has a large opening at the joint to the cylindrical base portion through which a roller or brush may be dipped into the paint. A pair of parallel vertical projections extend upward from the horizontal plate to hold, on edge, a paint brush resting on the horizontal plate. A limitation with this paint can accessory is that the vertical projections disposed extending from the horizontal plate interfere with use of a paint roller when distributing paint to a paint roller, or require an increased width of the tray so that the vertical projections do not interfere when distributing paint to a paint roller. In addition, the tray must always be mounted on a paint can and cannot be used by itself. Moreover, typical paint cans do not have a sufficient diameter to get a normal roller into them.

An example of a paint brush and paint roller holder adapted to be releasable connected to an upright end wall of a paint tray is disclosed in U.S. Pat. No. 4,890,353 granted to Shannon, et al. Shannon, et al. discloses a holder which includes a means for clamping to both sides of the end wall of the paint tray, and a generally horizontally disposed platform that is positioned above the tray. The platform is structured to support both a paint brush and a paint roller separately, allowing free access to the paint by either the paint brush or paint roller, and facilitating paint drippings therefrom to fall freely back into the paint tray. One drawback with the releasable paint brush and paint roller holder is it increases the number of pieces of equipment and cost (for a separate brush holder) required by a painter in painting the interior of a room. Another drawback of the releasable holder is its ability to effectively attach and remain attached to the end wall of a paint tray during use without becoming loose.

For completeness, U.S. Pat. No. 4,025,205 granted to Hawk (which does not deal with the problem of holding a brush); U.S. Pat. No. 4,949,864, granted to LaKier (which cannot be used in conjunction with a paint roller and tray); and U.S. Pat. No. 5,217,193 granted to Drucker, disclose various devices for use in painting. Hawk discloses a paint roller support member for use with a paint tray. The paint tray includes a substantially coplanar front and rear ends, a paint well adjacent to and below the rear ends for storing a supply of paint, and an inclined surface tapering upwards from the well to the front end for rolling excess paint off the paint roller. The paint tray and the roller support member coact for supporting at least one portion of the paint roller above the well and with the paint roller handle resting on the front end of the tray thereby allowing excess paint from the roller to drip back into the well.

LaKier, discloses a paint brush holder which may be attached to a standard paint can and used to progressively lower a paint brush into a can of paint as paint is extracted from the can. One side of the holder is in a pivotal relationship with the can, and is connected to the opposite side of the holder by means of a tie or other connecting arrangement whose length may be variably and selectively adjusted. The tie is used to allow the side of the holder which is in a pivotal relationship with the paint to lower the paint brush into the paint can as the level of paint within the paint can is reduced.

Drucker, an earlier issued patent by the inventor of the present invention for an improved paint tray with paint brush holder, discloses a paint can holder for an angled roof. The paint can holder includes a tray for supporting one of two different sized paint cans eliminating the need for readjustment, means for releasably attaching the paint can to the tray so that the paint tray and holder can be carried from one location to another by lifting the handle on the paint can, and a pair of adjustable legs for stabilizing the tray in a horizontal position on an angled roof.

There is a need for a paint tray with paint brush holder that allows a painter to quickly alternate between use of a paint roller and a paint brush in that the paint tray provides a secure and non-interfering place for positioning the paint roller or paint brush when using the other.

SUMMARY OF THE INVENTION

Accordingly, it is an object of the present invention to provide an improved paint tray with brush holder in which a paint brush is easily and quickly retained in a generally horizontally disposed orientation across upper edges of adjacent raised side walls, i.e., corner, adjacent the paint well or reservoir.

It is another object of the present invention to provide an improved paint tray with paint brush holder in which a paint brush in its retained position does not interfere with the primary purpose of a paint tray, i.e., interfere with the paint well and the ability of a painter to access the paint well with a paint roller.

It is also another object of the present invention to provide an improved paint tray with paint brush holder in which the paint brush holder effectively retains a paint brush in a secured position reducing the likelihood of the paint brush being dislodged particularly when distributing paint from the paint well onto a paint roller.

It is still another object of the present invention to provide an improved paint tray with paint brush holder which can hold a paint roller and retain a paint brush in its secured position when carrying the paint tray from one location to another location.

It is a further object of the present invention to provide an improved paint tray that is simple in construction and which may be manufactured relatively simply and inexpensively for widespread use by professional painters or homeowners for use in interior and exterior painting.

Certain of the foregoing and related objects are readily obtained in a paint tray with paint brush holder for use with a paint roller and paint brush, the paint tray having a bottom member having a outer edge and a vertically extending surrounding wall connected to said outer edge of said bottom member. The vertically extending surrounding wall includes a front wall, and opposite end wall, and a pair of opposite side walls. The bottom member adjacent said end wall of said surrounding wall forms a paint well for storing a supply of paint. The bottom member has an inclined surface tapering upwardly from said paint well for rolling excess paint from a paint roller. The paint tray further includes retaining means for releasably retaining a paint brush across an upper edge of said end wall and an upper edge of an adjacent side wall.

The retaining means includes a first pair of spaced apart tabs extending vertically upward from said upper edge of said end wall and a second pair of spaced apart tabs extending from said upper edge of said adjacent side wall. Preferably, the first pair of tabs are spaced apart to receive a brush end of the paint brush and said second pair of tabs are spaced apart to receive a handle end of the paint brush, and said first and said second tabs include vertically extending opposed inner facing surfaces and downwardly sloping outer surfaces. Desirably, the paint tray further including a recessed section in a lower edge of said end wall which is in vertical registry to said first pair of tabs and a recessed section in a lower edge of said adjacent side wall which is in vertical registry of said second pair of tabs so that said paint tray with paint brush holder is stackable one on top of another. More preferably, the paint tray further including a pair of L-shaped legs extending downwardly from a bottom surface of said bottom member adjacent each of said side walls and said front wall, and the paint tray is fabricated and molded in one piece from a plastic material.

Certain of the foregoing and related objects are also readily obtained in a paint tray with brush holder wherein said retaining means includes an upper edge of said end wall having a first cutout and an upper edge of said adjacent side wall having a second cutout. Preferably, said first and second cutouts are generally rectangularly shaped and include vertically extending spaced apart surfaces for receiving a brush end of the paint brush and said second cutout includes vertically extending spaced apart surfaces for receiving a handle end of the paint brush. Most desirably, the vertically extending spaced apart surfaces are angled to correspond with a longitudinal axis of the paint brush. Most desirably, the paint tray further includes a brush tray horizontally extending outward from said end wall adjacent first cutout, the brush tray having a plurality of vertically extending conically-shaped points upon which a brush end of the paint brush rests.

BRIEF DESCRIPTION OF THE DRAWINGS

Other objects and features of the present invention will become apparent from the following detailed description considered in connection with the accompanying drawings, which disclose several embodiments of the invention. It is to be understood that the drawings are to be used for the purpose of illustration only and not as a definition of the limits of the invention.

In the drawings, wherein similar reference characters denote similar elements throughout the several views.

DESCRIPTION OF THE PREFERRED EMBODIMENTS

Figure 1:
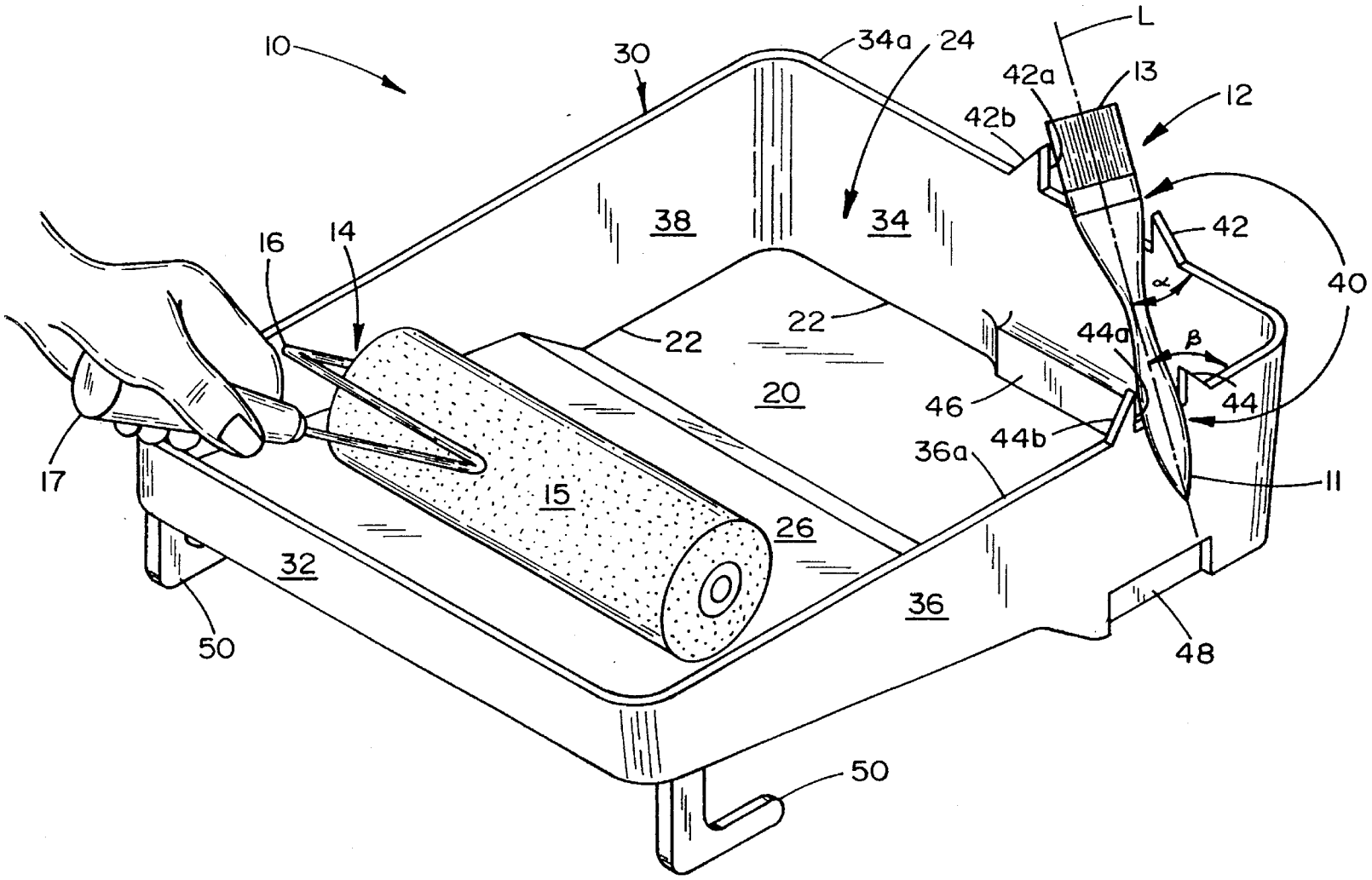
FIG. 1 is a perspective view of a paint tray with brush holder embodying the present invention illustrating a paint roller positioned therein and a paint brush retained thereon.

Turning now to the drawings and in particular to FIG. 1 which illustrates a paint tray with paint brush holder 10 embodying the present invention suitable for use with a conventional paint brush 12 having a handle end 11 and a brush end 13, and a paint roller 14 having a paint applying roller 15 of wool-like or flocking material which is rotably attached to one end of a bent wire or support rod or frame 16. The other end of frame 16 is attached to a handle 17. Specifically, paint tray 10 allows a painter to alternate between use of a paint roller and a paint brush for painting the interior of a room in that paint tray 10 provides a place for conveniently resting paint roller 14 and paint brush 12 when using the other, thus enabling a painter to work faster with quality results.

Paint tray 10 generally includes a bottom surface member 20 having an outer edge 22 and a vertically extending surrounding wall, generally designated by reference numeral 30, connected to outer edge 22 of bottom member 20. Paint brush 12 when not in use is conveniently retained on surrounding wall 30 and prevented from falling or inadvertently being jostled therefrom. Preferably, paint tray 10 is fabricated from metal or formed from a plastic material. Ideally, paint tray 10 is molded from plastic in one piece with the outer surfaces having a smooth non-stick surface for facilitating cleaning of paint after use.

Vertically extending surrounding wall 30 includes a front wall 32, and opposite end wall 34, and a pair of opposite side walls 36 and 38 between front wall 32 and end wall 34. Bottom member 20 adjacent end wall 34 of surrounding wall 30 forms a paint well 24 for storing a supply of paint. Bottom member 20 has an inclined surface 26 tapering upwardly from paint well 24 for rolling excess paint from paint roller 14.

Referring still to FIG. 1, paint tray 10 includes retaining means 40 for releasably retaining paint brush 12 across an upper edge 34*a* of end wall 34 and an upper edge 36*a* of adjacent side wall 36. Specifically, retaining means 40 includes a first pair of spaced apart tabs 42 extending vertically upward from upper edge 34*a* of end wall 34 and a second pair of spaced apart tabs 44 extending vertically upward from upper edge 36*a* of adjacent side wall 36. Preferably, first pair of tabs 42 are spaced apart for receiving brush end 13 of a brush 12 and second pair of tabs 44 are spaced apart to receive handle end 11 of paint brush 12. The distance between the spaced apart tabs can be sized to accept conventional standard small, medium or large brushes. Desirably, tabs 42 and 44 include a vertically extending opposed inner surfaces 42*a* and 44*a*, respectively, and downwardly sloping outer surfaces 42*b* and 44*b*, respectively. Although not shown, vertically extending opposed inner surfaces 42*a*, 44*a* are preferably angled to correspond to longitudinal axis L of paint brush 12.

Paint brush 12, end wall 34 and adjacent side wall 36 generally form a right triangle when viewed from above. Specifically, paint brush 12 forms the hypotenuse of the triangle while end wall 34 and adjacent side wall 36 form the legs. Preferably, first tabs 42 are located closer to the center of end wall 34 and second tabs 44 are located on adjacent side wall 36 near end wall 34. Specifically, angle $\beta$ formed between end wall 34 and a longitudinal axis L of paint brush 12 is greater than 45° and angle $\alpha$ formed between adjacent side wall 36 and longitudinal axis L of paint brush 12 is less than 45°. With angle $\beta$ being greater than 45° and angle e being less than 45° tends to position paint brush 12 closer to end wall 34 thereby reducing the possibility of interference of paint brush 12 with paint roller 14 when applying paint from well 24.

Preferably, paint tray 10 includes a recessed section 46 in a lower edge of end wall 34 which is vertically aligned or in registry with first pair of tabs 42, and a recessed section 48 in a lower edge of adjacent side wall 36 which is vertically aligned or in registry with second pair of tabs 44 so that paint tray 10 is stackable one on top of another in a nestable fashion; i.e., the tabs 42, 44 of the one tray being received in the recessed sections 46, 48, respectively of the tray thereabove.

Desirably, paint tray 10 includes a pair or L-shaped legs 50 extending downwardly from a bottom surface of bottom member 20, each L-shaped leg 50 is positioned adjacent each side wall 36 and 38 near front wall 32. L-shaped legs 50 provide for leveling of paint tray 10 when placed on the floor or on a flat surface. Also, L-shaped legs 50 provide for engaging a rung or step on a ladder (not shown) for holding paint tray 10 in place, particularly for when using a ladder to paint the ceiling.

Figure 2:
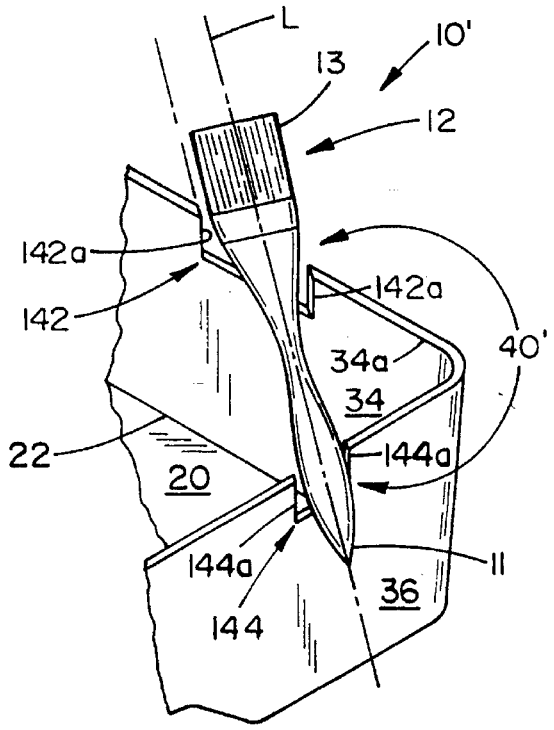
FIG. 2 is a fragmentarily-illustrated perspective view of an alternative embodiment of a paint tray with brush holder embodying the present invention and illustrating a paint roller positioned therein and a paint brush retained thereon.

Referring now to FIG. 2, therein illustrated is a preferred embodiment of the present invention which is easily and quickly manufactured. Specifically, paint tray with brush holder 10' is similar to tray 10 except for the fact that recessed sections 46, 48 are eliminated and not needed due to the employment of retainings means 40'.

Specifically, retaining means 40' includes an upper edge 34*a* of end wall 34 having a first cutout 142 and an upper edge of adjacent side wall 36 having a second cutout 144. Preferably, first and second cutouts, 142 and 144, are generally rectangularly shaped wherein first cutout 142 includes vertically extending spaced apart surfaces 142*a* sized for receiving brush end 13 of brush 12 and second cutout 144 includes vertically extending spaced apart surfaces 144*a* for receiving handle end 11 of paint brush 12. Desirably, vertically extending spaced apart surfaces 142*a* and 144*a* are angled to correspond to longitudinal axis L of paint brush 12.

Figure 3:
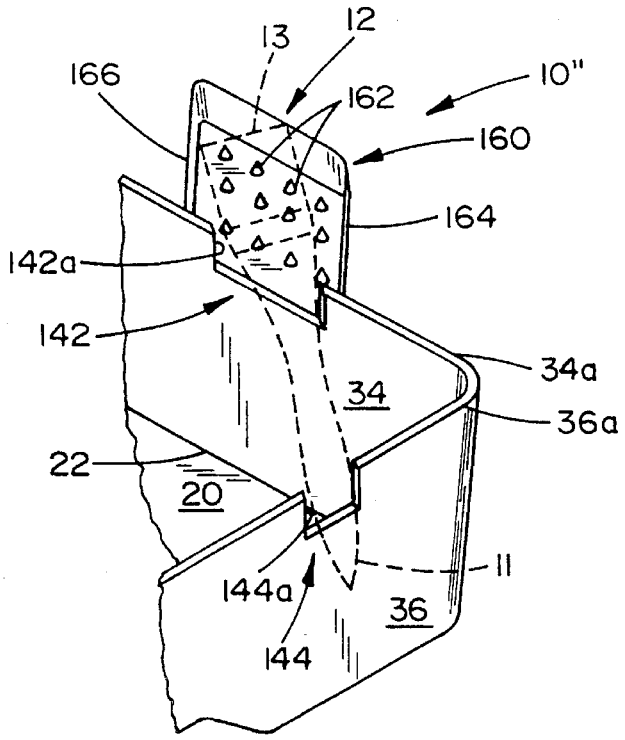
FIG. 3 is a fragmentarily-illustrated perspective view of a preferred alternative embodiment of a paint tray with brush holder embodying the present invention and illustrating a paint roller positioned therein and a paint brush, shown in phantom, retained thereon.

Referring now to FIG. 3, therein illustrated is another alternative embodiment of the present invention which is essentially the same as paint tray 10' shown in FIG. 2, except for the following additional points of distinction. Referring again to FIG. 3, paint tray 10" further includes a brush tray 160 extending horizontally outward from said end wall 34 adjacent first cutout 142. Preferably, brush tray 160 includes a plurality of vertically upstanding conically-shaped or semi-spherically-shaped points, knobs or stubs 162 on the top surface of tray base wall 164 upon which brush end 13 of the paint brush 12 rests, thereby raising the same off base wall 164 and any accumulated pool of paint. Brush tray 160 is also provided with a sidewall 166 extending about the periphery of base wall 164 to contain and prevent dripping of paint from tray 10".

Thus, while only several embodiments of the present invention have been shown and described, it is obvious that many changes and modifications may be made relative thereto without departing from the spirit and scope of the invention.

What is claimed is:

1. A paint tray with paint brush holder for use with a paint roller and paint brush, the paint tray comprising:

a bottom member having a outer edge;

a vertically extending surrounding wall connected to said outer edge of said bottom member, said vertically extending surrounding wall having a front wall, and opposite end wall, and a pair of opposite side walls;

said bottom member adjacent said end wall of said surrounding wall forming a paint well for storing a supply of paint;

said bottom member having an inclined surface tapering upwardly from said paint well for rolling excess paint from a paint roller; and retaining means for releasably retaining a paint brush across an upper edge of said end wall and an upper edge of an adjacent side wall.

2. The paint tray with paint brush holder according to claim 1, wherein said retaining means includes a first pair of spaced apart tabs extending vertically upward from said upper edge of said end wall and a second pair of spaced apart tabs extending from said upper edge of said adjacent side wall.

3. The paint tray with paint brush holder according to claim 2, wherein said first pair of tabs are spaced apart to receive a brush end of the paint brush and said second pair of tabs are spaced apart to receive a handle end of the paint brush.

4. The paint tray with paint brush holder according to claim 3, wherein said first and said second tabs include vertically extending opposed inner facing surfaces and downwardly sloping outer surfaces.

5. The paint tray with paint brush holder according to claim 4, further including a recessed section in a lower edge of said end wall which is in vertical registry with said first pair of tabs and a recessed section in a lower edge of said adjacent side wall which is in vertical registry with said second pair of tabs so that said paint tray with paint brush holder is stackable one on top of another in a nestable fashion.

6. The paint tray with paint brush holder according to claim 3, further including a pair of L-shaped legs extending downwardly from a bottom surface of said bottom member adjacent each of said side walls and said front wall.

7. The paint tray with paint brush holder according to claim 3, wherein said paint tray is fabricated from a plastic material.

8. The paint tray with paint brush holder according to claim 7, wherein said paint tray is molded in one piece from plastic .

9. The paint tray with paint brush holder according to claim 1, wherein said retaining means includes an upper edge of said end wall having a first cutout and an upper edge of said adjacent side wall having a second cutout.

10. The paint tray with paint brush holder according to claim 9, wherein said first and second cutouts are generally rectangularly shaped.

11. The paint tray with paint brush holder according to claim 10, wherein said first cutout includes vertically extending spaced apart surfaces for receiving a brush end of the paint brush and said second cutout includes vertically extending spaced apart surfaces for receiving a handle end of the paint brush.

12. The paint tray with paint brush holder according to claim 11, wherein said vertically extending spaced apart surfaces are angled to correspond with a longitudinal axis of the paint brush.

13. The paint tray with paint brush holder according to claim 12, wherein said paint tray is fabricated from a plastic material.

14. The paint tray with paint brush holder according to claim 13, wherein said paint tray is molded in one piece from plastic.

15. The paint tray with paint brush holder according to claim 12, further including a brush tray horizontally extending outward from said end wall adjacent said first cutout.

16. The paint tray with paint brush holder according to claim 15, wherein said brush tray includes a plurality of vertically extending conically-shaped points upon which a brush end of the paint brush rests.

* * * * *